US006439142B2

(12) United States Patent
Ebata et al.

(10) Patent No.: US 6,439,142 B2
(45) Date of Patent: Aug. 27, 2002

(54) EMBROIDERY SEWING MACHINE

(75) Inventors: Yoshikazu Ebata; Masashi Ninomiya; Eiji Murakami; Yasuro Sano; Akira Orll, all of Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 09/897,180

(22) Filed: Jul. 2, 2001

(30) Foreign Application Priority Data

Jul. 31, 2000 (JP) ..... 2000-230156

(51) Int. Cl.[7] ..... D05B 21/00
(52) U.S. Cl. ..... 112/102.5; 112/275; 112/470.04
(58) Field of Search ..... 112/102.5, 103, 112/470.04, 470.06, 475.19, 275, 277, 470.01

(56) References Cited

U.S. PATENT DOCUMENTS 4,688,498 A * 8/1987 Carlson ..... 112/103
5,271,344 A * 12/1993 Nishizawa et al. ..... 112/102.5
5,372,078 A * 12/1994 Hoshino et al. ..... 112/102.5 X
5,868,088 A * 2/1999 Mori et al. ..... 112/102.5
6,293,212 B1 * 9/2001 Ebata et al. ..... 112/103

FOREIGN PATENT DOCUMENTS

JP 2000-230157 * 7/2000
JP 2000-230158 * 7/2000
JP 2000-298255 * 9/2000

* cited by examiner

*Primary Examiner*—Peter Nerbun
(74) *Attorney, Agent, or Firm*—Nields & Lemack

(57) ABSTRACT

The invention has been made to provide an embroidery sewing machine which may be automatically operated to withdraw the embroidering frame to a predetermined inoperative position. More particularly, in case the power source switch is turned off, the power happens to be in failure, the power cord happens to be disconnected, the sewing operation is interrupted for a predetermined period of time, or the instruction is given to withdraw the embroidering frame to a predetermined inoperative position, the CPU 50 is responsive to these situations to control the X-Y moving mechanism 67 to withdraw the embroidering frame to the predetermined inoperative position.

33 Claims, 9 Drawing Sheets

EMBROIDERY SEWING MACHINE

BACKGROUND OF THE INVENTION AND RELATED ART STATEMENT

1. Field of the Invention

The present invention relates to an embroidery sewing machine having an embroidering frame holding a work to be stitched and a mechanism for moving the embroidering frame relative to a vertically reciprocating needle, and more particularly relates to an embroidery sewing machine which is responsive to the turning off operation of a power source switch to withdraw the embroidering frame from a position where the same is partly extended out from the base of sewing machine to a predetermined position where the embroidering frame is substantially located on the base of sewing machine.

2. Prior Art

Generally an embroidery sewing machine is operated to move an embroidering frame holding a work to be stitched in X-Y direction relative to a vertically reciprocating needle, thereby to form stitches on the work.

The embroidering frame is moved in a limited area which is determined in connection with an area in which a frame moving mechanism of the sewing machine may move. In case of the embroidery sewing machine, the frame moving mechanism is generally housed in a base of the sewing machine of a limited space. The embroidering frame is accordingly limited to move relative to the vertically reciprocating needle, additionally with existence of a standard portion of the sewing machine occupying a considerable part of the sewing machine body.

However, recently a frame moving mechanism has been proposed by the same applicant of this patent application, the frame moving mechanism including a moving assembly having another moving assembly additionally provided thereon to be relatively moved thereto formed as a multi-stepped moving assembly. According to the frame moving mechanism, the embroidering frame may be moved in a larger area than the area limited by the space of the base and by the standard portion of the sewing machine.

OBJECTS OF THE INVENTION

But apart from this advantage, in case the power source is turned off while the embroidering frame is partly extended out from the base of sewing machine and remains to be returned to a predetermined rest or inoperative position, or in case the sewing machine is stopped during stitching operation due to power failure or disconnection of electric cord from the power source, the sewing machine may happen to remain as occupying a large area or space with the embroidering frame being considerably extended out from the sewing machine. Further, in case the thread is changed from one color to another during embroidering operation while the embroidering frame is extended out from the sewing machine, the embroidering frame will become an obstacle to the thread changing operation. Particularly the multi-stepped moving assembly is mechanically fragile to impact or load, and further it is rather difficult to provide a mechanism that is manually operated to withdraw the embroidering frame to the rest or inoperative position.

The invention has been provided to eliminate the defects and disadvantages of the prior art. It is, therefore, a primary object of the invention to provide an embroidery sewing machine which is prevented from being left with the embroidering frame being partly extended out from the base of sewing machine while the sewing machine remains unused.

It is another object of the invention to provide an embroidery sewing machine which is responsive to the turning off operation of a power switch to withdraw the embroidering frame from a position where the same is partly extended out from the base of sewing machine to a predetermined position where the same is substantially located on the base of sewing machine.

It is another object of the invention to provide a memory for memorizing a stitching position of the embroidering frame so that the embroidering frame may be automatically returned to the stitching position from the withdrawn position.

It is another object of the invention to provide a detector for detecting turning off operation of a power switch and a device operated in association with the detector to maintain supply of power until the embroidering frame is withdrawn to the predetermined position.

It is another object of the invention to provide a detector for detecting a predetermined elapse of time after the power source switch is turned off and a device operated in association with the detector to withdraw the embroidering frame to the predetermined position and simultaneously intercepting the power source.

It is another object of the invention to provide a loose stitch preventing program memory so that the stitches may be formed to prevent the preceedingly formed stitches from being loose before the embroidering frame is withdrawn to the predetermined position.

It is another object of the invention to withdraw the embroidering frame a shortest allowable distance towards the base of sewing machine so that the embroidering frame may be quickly returned to the stitching position.

It is still another object of the invention to initialize an embroidering frame carrying member prior to starting the embroidery stitching operation or the purpose of avoiding interference of the embroidering frame with another member of the sewing machine during withdrawing movement of the embroidering frame to the predetermined position.

SUMMARY OF THE INVENTION

For attaining the objects, the embroidery sewing machine of the invention comprises a stitch forming means including a vertically reciprocating needle, a means for holding a work to be stitched, a moving means for moving the work holding means relative to the vertically reciprocating needle, wherein in case a power source switch is turned off, the sewing operation is interrupted for a predetermined period of time, or an instruction is given to withdraw the moving means to a predetermined positron (or a position where the moving position is housed), the moving means is automatically operated to withdraw to the predetermined position. Thus, the sewing machine may be prevented from being left unused while the work holding means remains as is extended out from the sewing machine.

The power off condition is detected by a detector and subsequently power is maintained as supplied by a power supply maintaining means such that the moving means may be operated by the maintained power to withdraw to the predetermined position.

According to the invention, in case the power source is intercepted, power is maintained to withdraw the moving means. Therefore, the sewing operation will not be interrupted for a long time without withdrawal of the moving means to the predetermined position. The means for maintaining the power supply may include various means. This means may, however, be something responsive to a switch-off signal to immediately postpone the power interception for a predetermined period of time. In this connection, a battery may be provided as a power source to be automatically switched over thereto at the time of power interception. This may cope with power failure or incidental disconnection of power cord.

Interruption of sewing operation for a predetermined period of time may be detected by a detector for detecting the stopped condition of the stitch forming means and the work holding means, and discriminated by a means for deciding if the stopped condition has continued for a predetermined period of time and for withdrawing the moving means to the predetermined position at the end of the predetermined period of time. Therefore, since the moving means moving the work holding means is withdrawn to the predetermined position in case the sewing machine has been stopped for a predetermined period of time, the sewing machine may be prevented from being left unused for a long time while the work holding means remains as is extended out from the sewing machine. Preferably, the predetermined period of time may be optionally set by the user by operating a means provided for setting the period of time.

The instruction for withdrawing the moving means may be given by the user who operates an operating means provided to be accessed by the user and the instruction may be carried out by a means responsive to operation of the operating means to withdraw the moving means to the predetermined position. Thus, the withdrawing means will operate in response to operation of the operating means to withdraw the moving means. Therefore, the sewing machine may be prevented from being left unused while the work holding means remains as is extended out from the sewing machine in case the sewing operation is interrupted. The withdrawing means may be provided as indicated, for example, at a touch panel of a display.

The moving means may be of a multi-stepped extendible mechanism composed of at least two moving assemblies, wherein one moving assembly has another moving assembly mounted thereon to be movable relative thereto. On the other hand, the withdrawing means is preferably formed to withdraw more than a half of the total length of the moving assemblies. In case at least more than a half of the total length of the moving assemblies is withdrawn, the moving assemblies may be prevented from damage which may otherwise be caused at the time of impact given thereto.

Further, a means may be provided to be operated by the user for optionally setting the predetermined position to which the moving means is withdrawn, and further a means may be provided to be operated in accordance with information including a weight of the moving means to automatically decide the predetermined position.

Preferably a means is provided for detecting a position of the work holding means so that the position of the work holding means prior to withdrawal to the predetermined position may be memorized for the purpose of automatically returning the work holding means to the memorized position.

The withdrawing direction may be either or one of the X and Y directions. However, normally the width direction (Y direction) is sufficient.

It is further preferable that the stitches may be formed for preventing loosening of the preceedingly formed stitches before the work holding means is withdrawn to the predetermined position so that the embroidery stitching operation may be started again smoothly.

Further, a means may be provided for rendering the sewing machine into an economy mode to save power immediately after the work holding means or the moving means has been withdrawn to the predetermined position.

Further, during withdrawing movement of the moving means to the predetermined position, it may happen that the work holding means (embroidering frame) will contact the other constituent member or members of the sewing machine. This problem must be taken into consideration especially in case the work holding means is capable of movement in a larger area.

In order to solve the problem, it is preferable to provide a means for detecting prior to withdrawal of the moving means if the work holding means is mounted or not on the moving means so that the moving means may be withdrawn to the predetermined position only when the work holding means is not mounted to the moving means. The permission that the moving means may be withdrawn to the predetermined position only when the work holding means is not mounted to the moving means may be applied additionally to the cases wherein the power source switch is turned on or off, wherein the moving means is withdrawn when the sewing machine is switched over from embroidery stitching to ordinary stitching, or wherein the moving means is subjected to initializing operation to move to the original stitching point at the time of starting the embroidery stitching operation.

In case presence of the work holding means is detected, the initializing operation may be carried out immediately or in response to an initializing instruction to be given after the work holding means is removed from the moving means. It is preferable to provide a means for giving a notice to the user in case presence of the work holding means is detected. Further, in case the initializing operation is carried out in response to the initializing instruction, it is preferable to provide a means for giving a notice to the user to give the initializing instruction. The noticing means nay be a display which is normally provided on the sewing machine.

DETAILED DESCRIPTION OF PREFERRED EMBODIMENTS

The invention will be described in detail in reference to the preferred embodiments of the invention.

Figure 1:
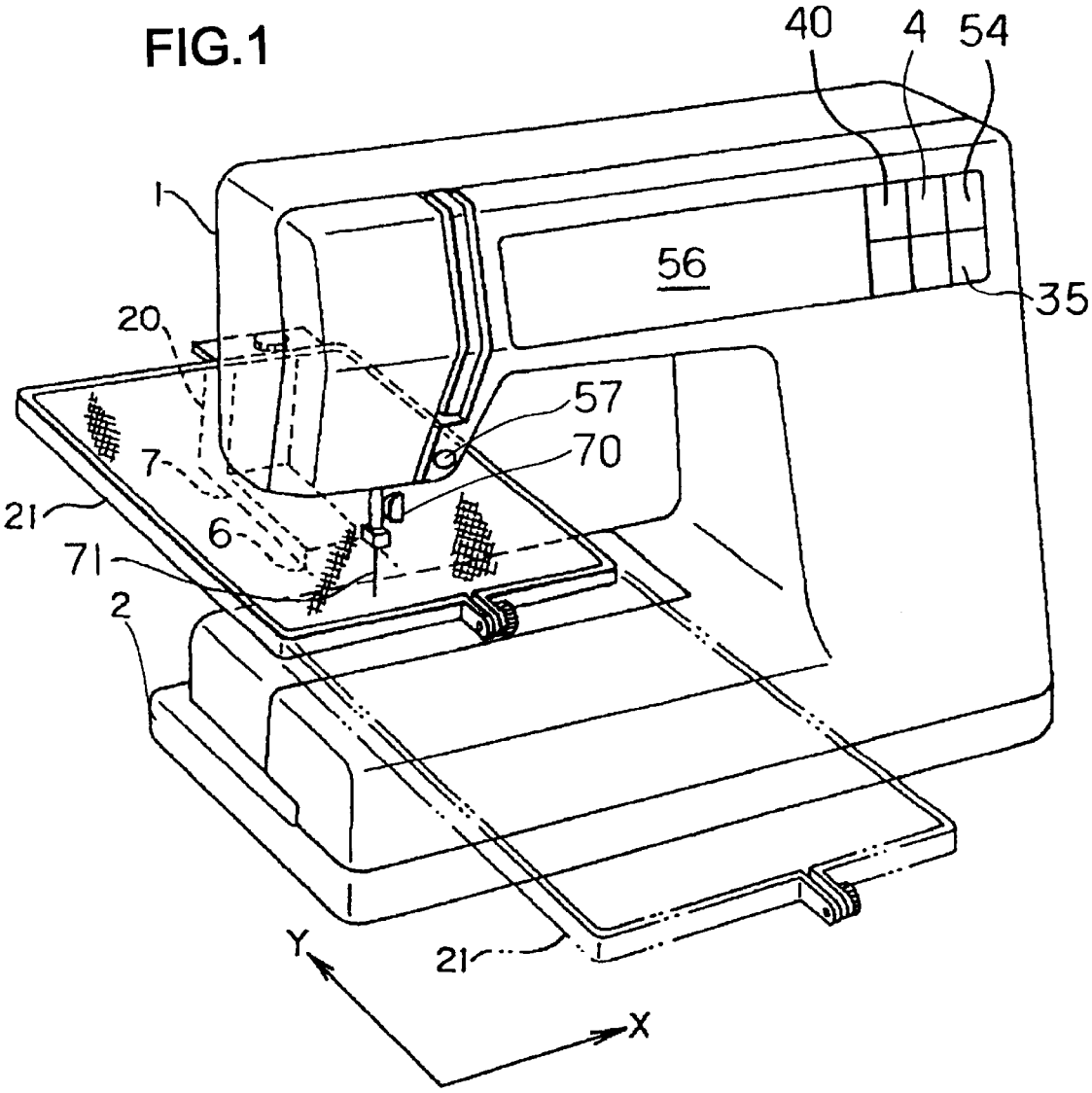
FIG. 1 is a perspective view of an embodiment of embroidery sewing machine of the invention.
Figure 2:
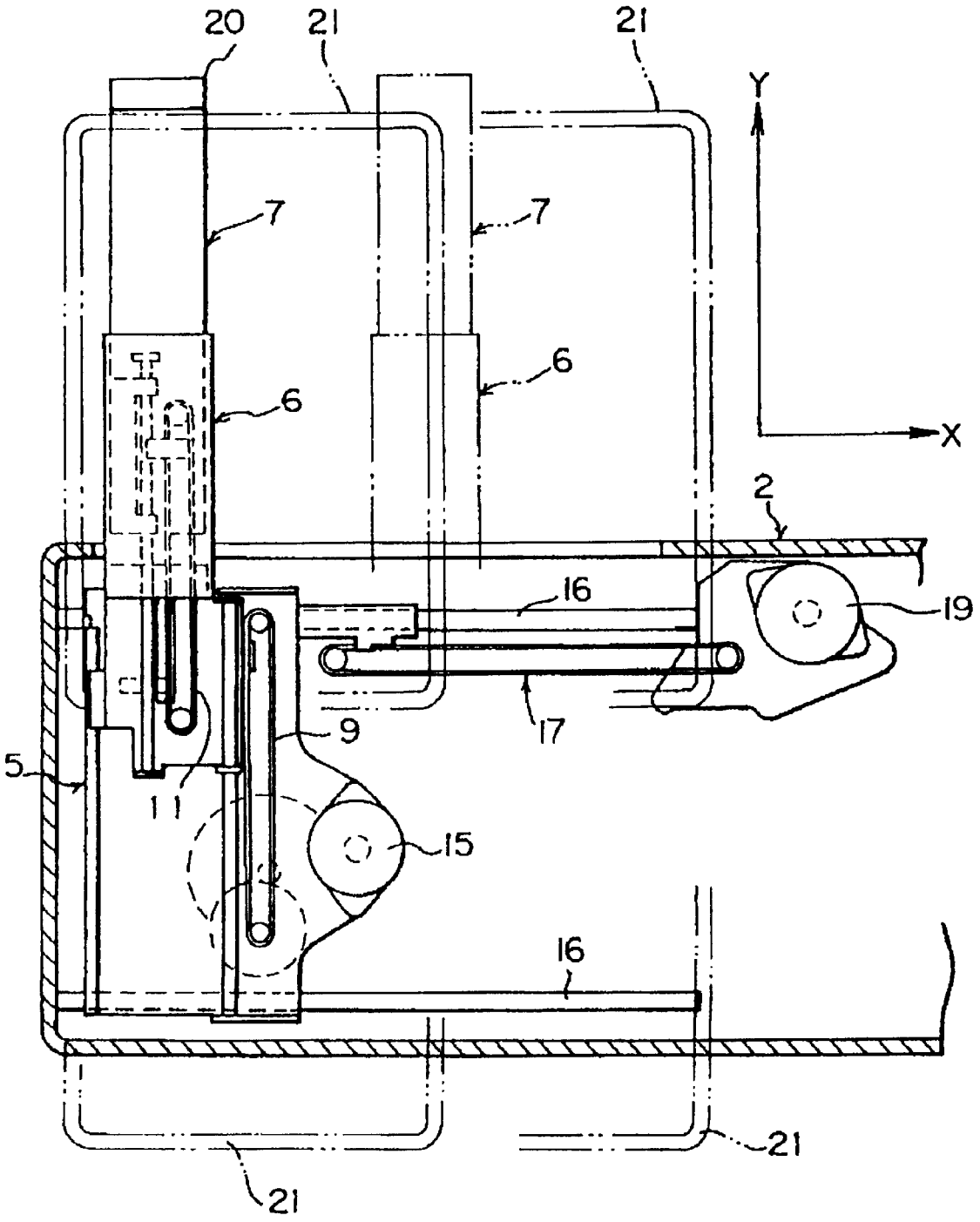
FIG. 2 a plan elevational view of an embodiment of X-Y moving mechanism of the invention.

As sown in FIG. 1, the embroidery sewing machine of the invention has an arm frame 1 extending horizontally from the top of an upright standard and a base 2 extending horizontally from the bottom of the standard. As shown in FIG. 2, an X-Y moving mechanism is provided in the base 2.

A distal end carriage 7 is operatively connected to the X-Y moving mechanism 67 and may be moved as is extended out of the base 2. The distal end carriage 7 has a distal end 20 to which an embroidering frame 21 is removably mounted. In the arm frame 1, there is provided a stitch forming mechanism 62 (FIG. 3) including a vertically reciprocating needle bar 70 and a needle 71 attached to the lower end of the needle bar 70.

The embroidering frame 21 has a work such as a cloth held thereon and is moved in X-Y direction relative to the needle 71 as the distal end carriage 7 is moved such that stitches may be formed on the cloth as the needle 71 is vertically reciprocated. The embroidery stitching operation may be selected by operating a stitching mode selecting button 54 (FIG. 3) which is otherwise operative to provide an ordinary stitching mode wherein a work such as a cloth is transported relative to the vertically reciprocating needle 71 by a work feeding device (not shown) such that stitches may be formed on the cloth.

A start/stop switch 57 (FIG. 3) is provided, which is operated to start or stop the operation of the sewing machine.

As shown in FIG. 2, the X-Y moving mechanism includes a multi-stepped extendible assembly substantially composed of a base carriage 5 which may be moved in X-direction (width direction of sewing machine), an intermediate carriage 6 which is mounted on the base carriage 5 and may be moved in Y-direction perpendicularly of the X-direction and the distal end carriage 6 which is mounted on the intermediate carriage 6 and may be moved in Y-direction. According to the embodiment, the extendible assembly is two-stepped. It is, however, needless to say that the assembly may be made more than two-stepped. The embroidering frame 21 is mounted to the end 20 of the distal carriage 7 and is moved in X-Y direction as the distal end carriage 7 is moved. The moving amount of the distal end carriage 7 will enlarge the moving area of the embroidering frame 21 in X-Y direction in addition to the moving area wherein the intermediate carriage 6 may be moved in X-Y direction.

The intermediate carriage 6 is fixedly connected to a first endless belt 9 which is driven by a Y-direction drive motor 15, and may be reciprocatingly moved in Y-direction. A second endless belt 11 is provided on the base carriage 5 and is moved in association with the movement of the intermediate carriage 6. The distal end carriage 7 is fixedly connected to the second belt 11 such that the same may be reciprocatingly moved in Y-direction as the second belt 11 is moved.

An x-direction drive motor 19 is provided to move a third endless belt 17 which is fixedly connected to the base carriage 5 to reciprocatingly move the same in X-direction along a guide rail 16.

The frame moving mechanism including the multi-stepped extendible assembly is disclosed in detail, for example, in U.S. Pat. No. 604,351, the disclosure of which is herein incorporated by reference.

Figure 3:
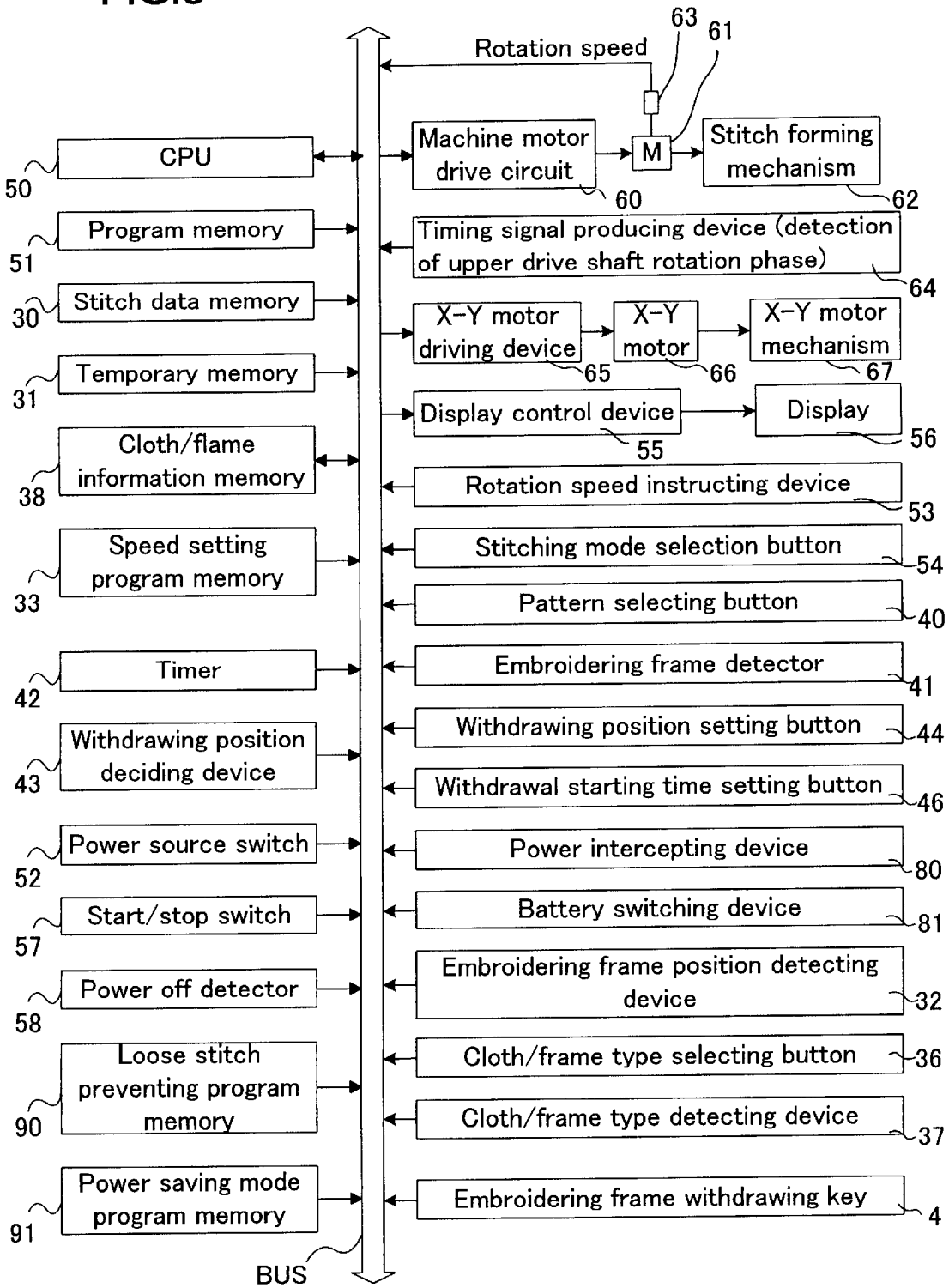
FIG. 3 is a block diagram showing the functions of the invention.

FIG. 3 is a block diagram showing a hardware of essential elements of the sewing machine. These elements will be described in reference to FIG. 1.

CPU 50 is operated in accordance with the programs stored in a program memory 51 to do control operations. In case of the ordinary stitching operation, the CPU 50 is responsive to an instruction from a rotation speed instructing device 53 which may be a foot operated controller or the like to control a machine motor drive circuit 60, thereby to drive a machine motor 61 at a speed instructed by the rotation speed instructing device 53 and thus to drive the stitch forming mechanism 62. The embroidery stitching operation may be carried out at a rotation speed of the machine motor 61 decided by a speed setting program stored in a speed setting program memory 33.

As shown in FIG. 1, the stitch forming mechanism 62 includes the needle bar 70, needle 71 and the cloth feeding device (not shown) which is operated in synchronism with vertical reciprocating movement of the needle 71 to transport the cloth relative to the needle 71 to form stitches on the cloth. The number of times of rotation of the machine motor 61 is detected by a motor rotation detector 63 and is fed back to the CPU 50 so as to be used for speed control of the machine motor 61.

The embroidery sewing machine is provided with an X-Y motor drive circuit 65, X-Y motors 66 and the X-Y moving mechanism 67 in addition to the machine motor drive circuit 60 and is operated in accordance with the pattern data read out from a stitch data memory 30 to carry out a pattern stitching operation. As mentioned hereinbefore in reference to FIG. 1, the X-Y moving mechanism 67 includes the distal end carriage 7 having the end 20 to which the embroidering frame 21 is mounted, the embroidering frame 21 having a cloth held thereon and being moved in X-Y direction relative to the reciprocating needle such that stitches may be formed on the cloth. In FIGS. 1 and 2, the sign X indicates the width direction of the sewing machine body and Y indicates the depth direction of the sewing machine body.

A timing signal producing device 64 is provided to detect the rotation phases of an upper drive shaft of the sewing machine and produce the signals indicating the positions of vertically reciprocating needle 71 which is operatively connected to the upper drive shaft. The signals are used to synchronize the movement of the X-Y moving mechanism 67 with the movement of the vertically reciprocating needle 71, the X-Y moving mechanism 67 being moved by way of the X-Y motor drive circuit 65 and the X-Y motors 66 which are under control of the CPU 50 having the timing signals entered thereto.

The embroidery stitching operation and the ordinary stitching operation may be alternatively selected by operating the stitching mode selecting button 54 which is provided on a front side of the arm frame 1 of sewing machine as shown in FIG. 1.

A display 56 is provided on the front side of the arm frame 1 of sewing machine and is operated to display various information under control of a display control device 55 which is operated in accordance with the instructions from the CPU 50 as shown in FIG. 3.

Further, a temporary memory 31 is provided.

A frame position detector 32 is provided to detect the position of the embroidering frame 21. According to the embodiment, the position of the embroidering frame 21 may be successively detected from the initial position of the same and the stitch data stored in the stitch data memory 30. Alternatively, the position of the embroidering frame 21 may be detected by a detector provided to the X-Y motors 66, the Z-Y moving mechanism 67, the distal end carriage 7 or the embroidering frame 21 itself.

The CPU 50 has further a cloth/frame type selecting button 36, a cloth/frame type detector 37 and a cloth/frame type information memory 38 connected thereto.

The cloth/frame type selecting button 36 is operated by a machine user to enter a type of cloth and/or a type of embroidering frame. The type of cloth may be classified on the basis of weight, thickness and/or material. The material may be mainly determined on the basis of friction resistance. The type of embroidering frame may be classified on the basis of size, weight band the like. The cloth and embroidering frame may, however, be otherwise classified as required. The information of the types of cloth and embroidering frame is stored in the cloth/frame type information memory 38 and may be read out therefrom by operation of the cloth/frame type selecting button 36.

The cloth/frame type detector 37 and the cloth/frame type selecting button 36 may be alternatively or both of the two may be provided.

The cloth/frame type detector 37 is provided to detect the type of embroidering frame 21 mounted to the end 20 of distal end carriage 7 and the type of cloth held on the embroidering frame 21. For example, the type of embroidering frame 21 may be discriminated by a sensor arranged on the end 20 of distal end carriage 7 for detecting a discrimination signal provided on the embroidering frame 21. The type of cloth may be discriminated by a photosensor for detecting a reflected light or by a weight sensor for detecting the weight of cloth. In response to the type of cloth or of embroidering frame detected by the cloth/frame type detector 37, the corresponding information is read out from the cloth/frame information memory 38.

An embroidering frame detector 41 is provided to detect the embroidering frame 21 mounted to the end 20 of distal end carriage 7. Any sensor may be available if it detects the presence of embroidering frame 21 mounted to the frame mounting end 20. The frame detector 41 may be a sensor which will produce a discriminating signal in response to a type of embroidering frame 21.

The CPU 50 further has a timer 42 connected thereto for measuring a time span in which the sewing machine is stopped. In case the CPU 50 recognizes the stop of the stitch forming mechanism 62 and of the X-Y moving mechanism 67, it gives an instruction for operating the timer 42 to measure the time span of stop. In case a predetermined span of time is reached, the distal end carriage 7 is withdrawn to a predetermined position after the position of embroidering frame 21 detected by a frame position detector 32 is stored in the temporary memory 31. The predetermined span of time may be optionally decided by operating a withdrawal start setting button 46. The withdrawal position is normally a position in the base 2 where the distal end carriage 7 is housed, but may be optionally decided by operating a withdrawing position setting button 44. With operation of the withdrawing position setting button 44 to move a shortest possible distance, the time may be shortened taken by the embroidering frame 21 for returning to the position preceedingly memorized in the temporary memory 31.

Further, an withdrawing position deciding device 43 is provided. The device is operated to decide a position to which the embroidering frame 21 is withdrawn in accordance with the type of embroidering frame 21 selected by operation of the cloth/frame type selecting button 36. With the withdrawal position deciding device 43 being provided, the withdrawal position may be decided in consideration of the size and weight of embroidering frame 21. Thus a suitable position may be decided in accordance with the type of embroidering frame 21. When the start/stop button 57 is operated after the embroidering frame 21 is withdrawn, the CPU 50 is operative to read out the position of the embroidering frame 21 preceedingly memorized in the temporary memory 31 to control the movement of the X-Y moving mechanism 67, thereby to return the embroidering frame 21 to the position memorized in the temporary memory 31 and simultaneously start the embroidery stitching operation.

A power source switch 52 is provided so as to be operated to turn the sewing machine electrically on or off. According to the embodiment, in case the power source switch 52 is turned off, the sewing machine is not instantly cut off from the power source and remains electrically on for a predetermined time. Namely, the CPU 50 is responsive to the off signal from the power source switch 52 to give a signal to a power intercepting device 80 after elapse of a predetermined time. The power intercepting device 80 is then operative to electrically cut off the sewing machine from the power source.

The predetermined time is a time that is required to move the X-Y moving mechanism 67 to the initial position wherein the base carriage 5, the intermediate carriage 6 and the distal end carriage 7 are returned to predetermined positions (original positions) respectively in the base 2 of the sewing machine. According to the embodiment, the interception of power source is postponed until the respective carriages 5, 6, 7 are confirmed to have been returned to the predetermined positions in the base 2 of sewing machine.

Namely, the CPU 50 is responsive to the power source turning off signal to control the movement of X-Y moving mechanism 67 to move the carriages 5, 6, 7 to the predetermined positions (original positions) respectively. With confirmation of the carriages 5, 6, 7 having been returned to the predetermined positions (original positions), the CPU 50 gives an instruction to a power intercepting device 80 to cut off the power source.

With combination of the constituent elements, the intermediate carriage 6 and the distal end carriage 7 may be prevented from remaining as extending out of the base 2 of sewing machine after the sewing machine is turned off.

According to the embodiment, a battery switching device 81 may be provided so as to be responsive to the turning off signal from the power source switch 52 to make operative a battery or the like (not shown) provided in the sewing machine as a support power source for returning the carriages 5, 6, 7 to the predetermined positions (original positions) respectively.

Further according to the embodiment, a power off detector 58 is provided to detect power failure or disconnection of a cord from the power source such that the detection signal from the power off detector 58 may make operative the battery to return the carriages 5, 6, 7 to the predetermined positions (original positions) respectively.

Further, a frame withdrawing key 4 is provided so as to be operated to make the CPU 50 operative to memorize the position of embroidering frame 21 in the temporary memory 31 and simultaneously control the movement of X-Y moving mechanism 67 to withdraw the distal end carriage 7 to a predetermined position.

The aforementioned predetermined positions are original positions of the respective carriages 5, 6 and 7 within the base 2 of sewing machine. The positions may, however, be optionally varied. For example, the respective carriages may be withdrawn only in the Y-direction such that the carriages may be so quickly returned to the stitching positions when the embroidery stitching operation is started again. In FIG. 2, the intermediate carriage 6 and the distal end carriage 7 are shown as extending out of the base 2. It is preferable that the carriages are withdrawn until at least more than a half of the total length is located within the base 2. In this condition, the damage of the carriages 6, 7 may be reduced in case impact is given to the carriages.

According to the embodiment, a loose stitch preventing program memory 90 is provided such that the CPU 50 may be responsive to operation of the embroidering frame withdrawing key 4 to control the movement of stitch forming mechanism 62 by use of the program stored in the memory 90 to form the stitches for preventing the preceedingly formed stitches from loosening prior to withdrawal of the embroidering frame 21.

In case the embroidering frame 21 is withdrawn after the loose stitch preventing operation is made, the irregularity of stitches will be prevented when the embroidery stitching operation is started again.

Further, according to the embodiment, a power saving mode program memory 91 is provided. The memory 91 is responsive to operation of the frame withdrawing key 4 to render the sewing machine into a power saving operation mode after the embroidering frame 21 is withdrawn to save the consumption of power.

Operation of the embodiment will be described in reference to FIG. 4.

Figure 4:
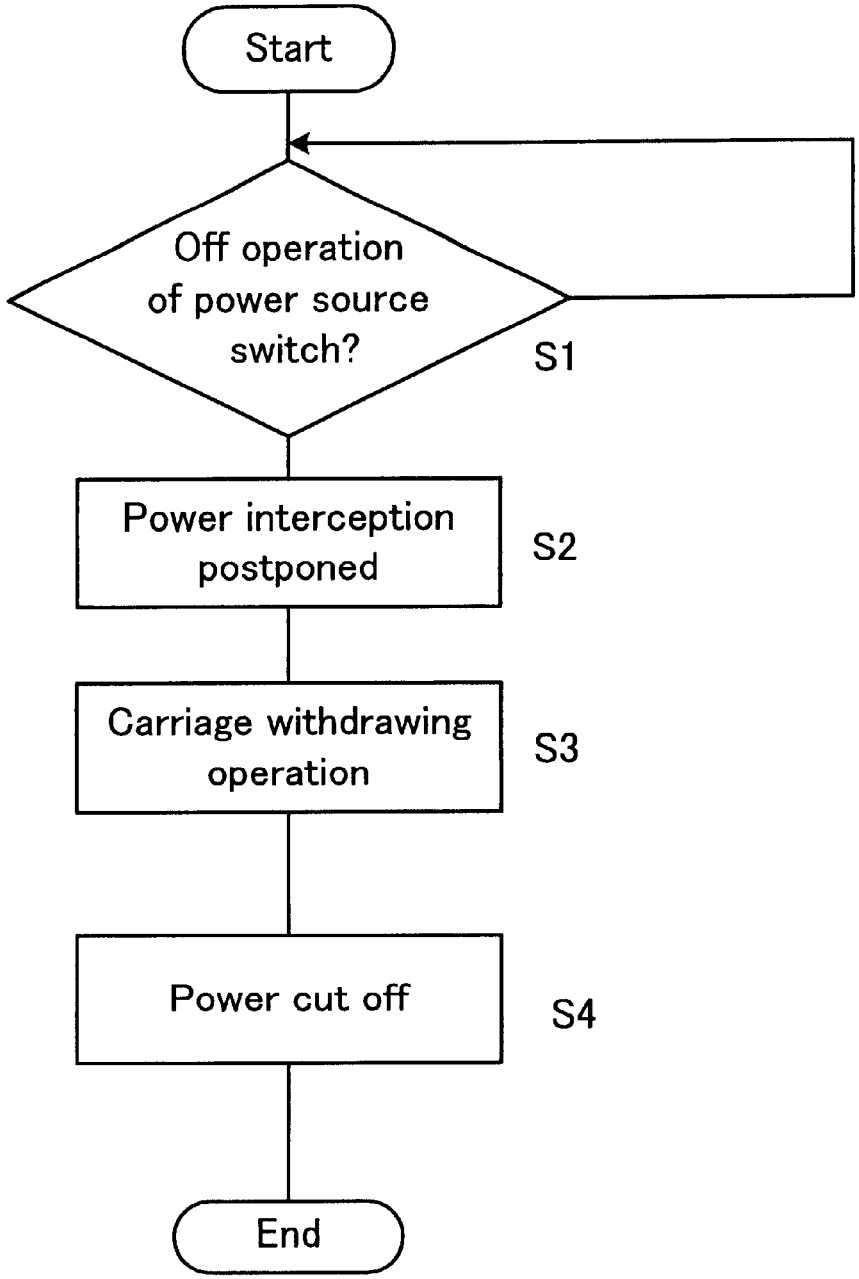
FIGS. 4 through 7 are flow charts showing the operations of the invention.

In FIG. 4, in case the power switch 52 is turned off (step S1), the CPU 50 will postpone the power interception (step S2), and control the X-Y moving mechanism 67 to withdraw the base carriage 5, the intermediate carriage 6 and the distal end carriage 7 to the predetermined positions (step S3). After the carriages have been withdrawn to the predetermined positions respectively, the CPU 50 will operate the power intercepting device 80 to intercept the power (step S4).

Figure 5:
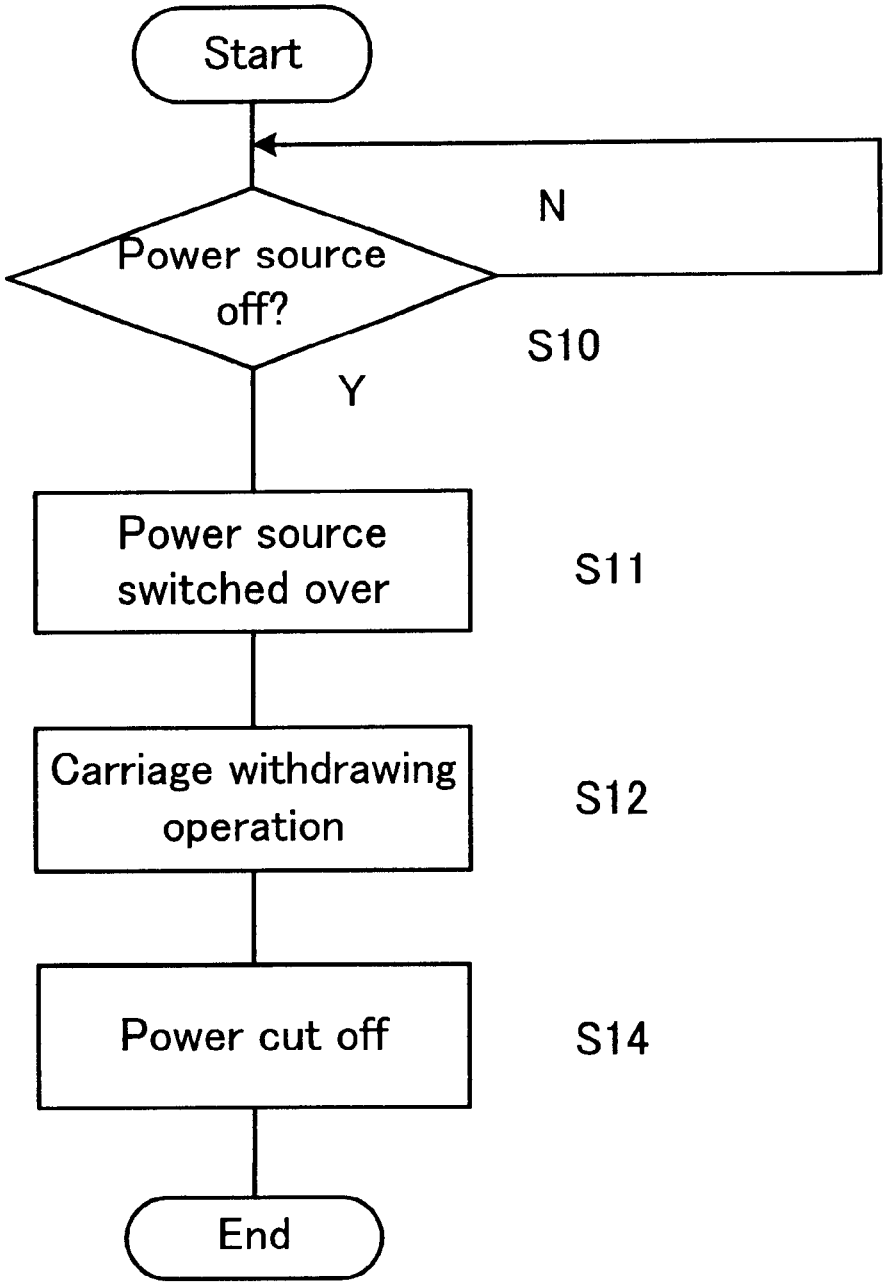

FIG. 5 shows the operation in case the power cord is disconnected to cause the sewing machine to be power off. When the power off detector 58 gives an off signal (step S10), the CPU 50 switches over the power source to the battery (step S11), thereby to control the X-Y moving mechanism 67 to withdraw the base carriage 5, the intermediate carriage 6 and the distal end carriage 7 to the predetermined positions respectively (step S12). After the carriages are withdrawn to the predetermined positions, the battery is cut off (step S13).

Figure 6:
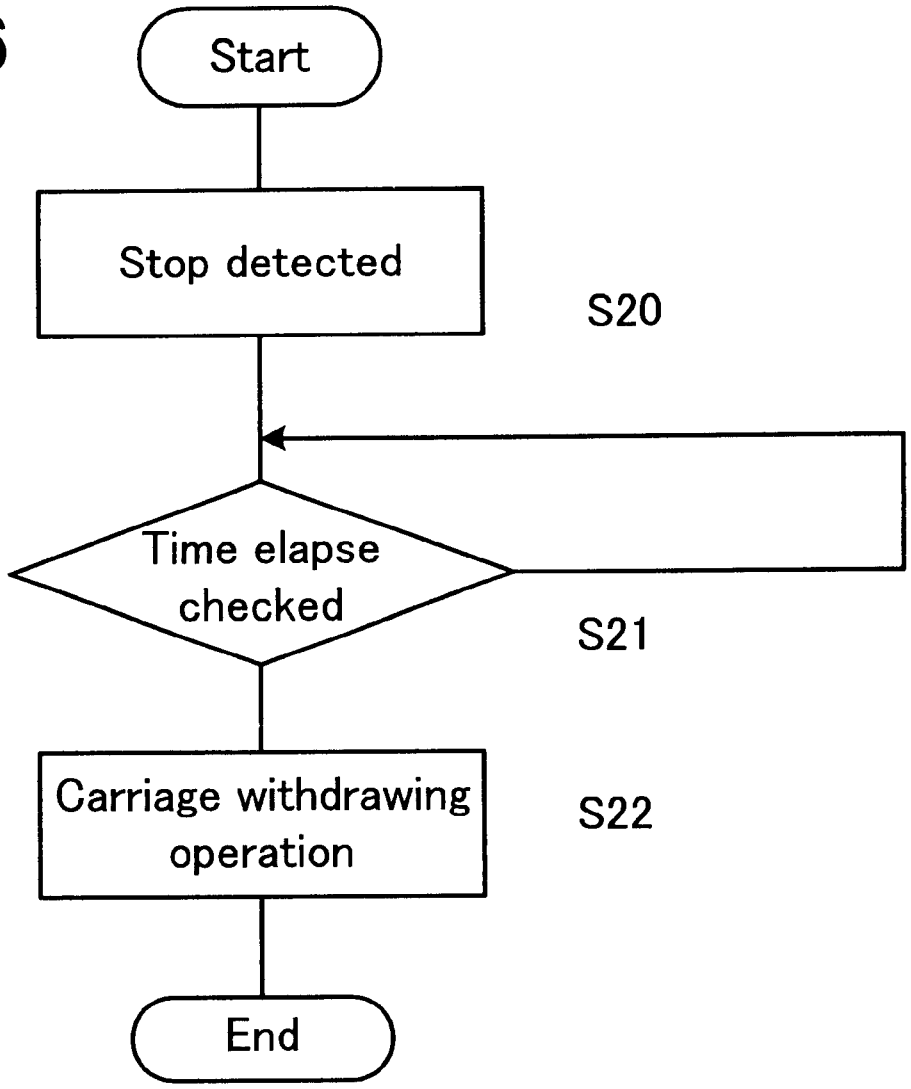

FIG. 6 shows the operation in case the sewing machine is standstill for more than a predetermined span of time. When the CPU 50 recognizes the stop of the stitch forming mechanism 62 and the X-Y moving mechanism 67 (step S20), it operates the timer 42 and checks the elapse of time (step S21). In case a predetermined time has elapsed, the CPU 50 gives the instruction to withdraw the carriages to the predetermined positions (step S22).

Though there is not shown a flow chart of the carriage withdrawing operation in case the frame withdrawing key 4 is operated, the operation is carried out by the instruction given by the CPU 50 which is responsive to operation of the frame drawing key 4.

Figure 7:
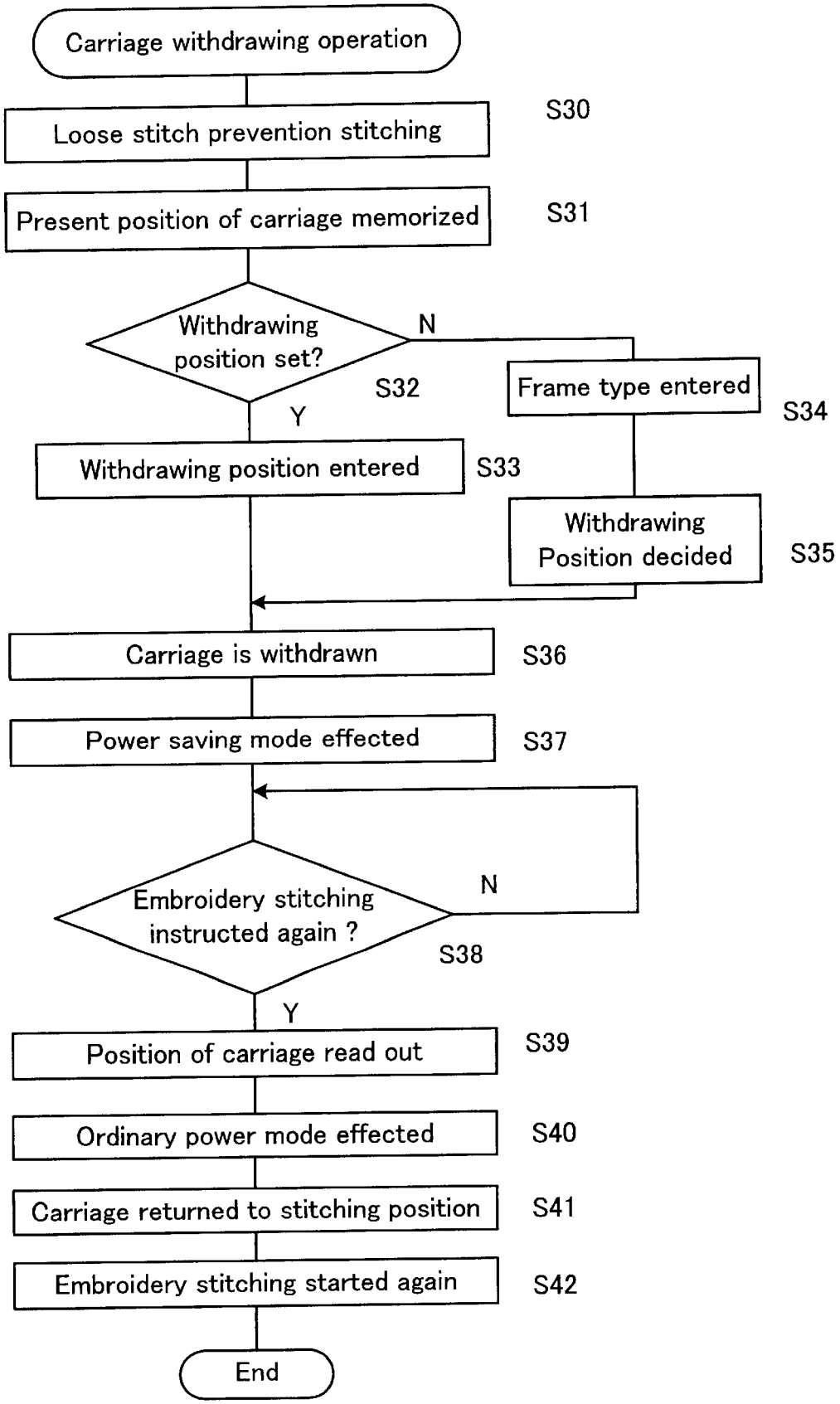

The carriage withdrawing operation of steps S3, S12 and S22 will be described in reference to FIG. 7.

At first, the CPU 50 gives an instruction for carrying out the loose stitch prevention stitching operation (step S30), though the operation may not be carried out.

Subsequently, the Present Position of distal end carriage 7 (embroidering frame 21) is memorized in the temporary memory 31 (step S31). In case the withdrawing position setting button 44 is operated to set the withdrawing position (step S32), the set position is read in (step S33). In case the withdrawing position is not set, the withdrawing position deciding device 43 reads in the type of embroidering frame 21 (step S34) and decides the withdrawing position (step S35), and then the carriage is withdrawn to the withdrawing position (step S36). After the carriage has been withdrawn to the withdrawing position, the sewing machine is switched over to the power saving mode (step S37).

In case the instruction is given by operation of the start/stop button 57 for starting the embroidery stitching operation again (38), the position of embroidering frame 21 preceedingly memorized in the temporary memory 31 is read out (step S39) and simultaneously the sewing machine is switched over from the Power saving mode to the ordinary mode (step S40). The X-Y moving mechanism 67 is then controlled to move the distal end carriage 7 to the former position, thereby to move the embroidering frame 21 to the former stitching position (step S41).] The embroidery stitching operation is started again (step S42).

With the combination of elements, the base carriage 5, the intermediate carriage 6 and the distal end carriage 7 may be automatically withdrawn to the predetermined positions respectively in case of turning off of power, power failure or disconnection of power cord.

Subsequently, another embodiment of the invention will be described.

According to the embodiment, the distal end carriage 7 is prevented from being withdrawn to the predetermined position while the embroidering frame 21 is mounted to the carriage 7, because the embroidering frame 21 may interfere with another member of the sewing machine on the way to the predetermined position.

Namely, the distal end carriage 7 is subjected to a series of initializing movements. For example, upon turning the power source on, the distal end carriage 7 is moved to a predetermined initial position. Prior to starting the embroidery stitching operation, the distal end carriage 7 is moved to a stitch starting original point. Further, in case the sewing machine is switched over from the embroidery stitching mode to the ordinary stitching mode, the distal end carriage 7 is moved to the predetermined initial position. In each case, the carriage 7 is prevented from being moved while the same has the embroidering frame 21 mounted thereto.

Each time of the distal end carriage 7 is moved, the CPU 50 discriminates by the signal from the frame detector 41 if the embroidering frame 21 is mounted to the distal end carriage 7. In case the there is the embroidering frame 21, the CPU 50 makes a warning at the display 56, and moves the carriage 7 after confirming absence of the embroidering frame 21.

Otherwise the CPU 50 may make a notice at the display 56 requiring the user to take the initializing operation again.

Figure 8:
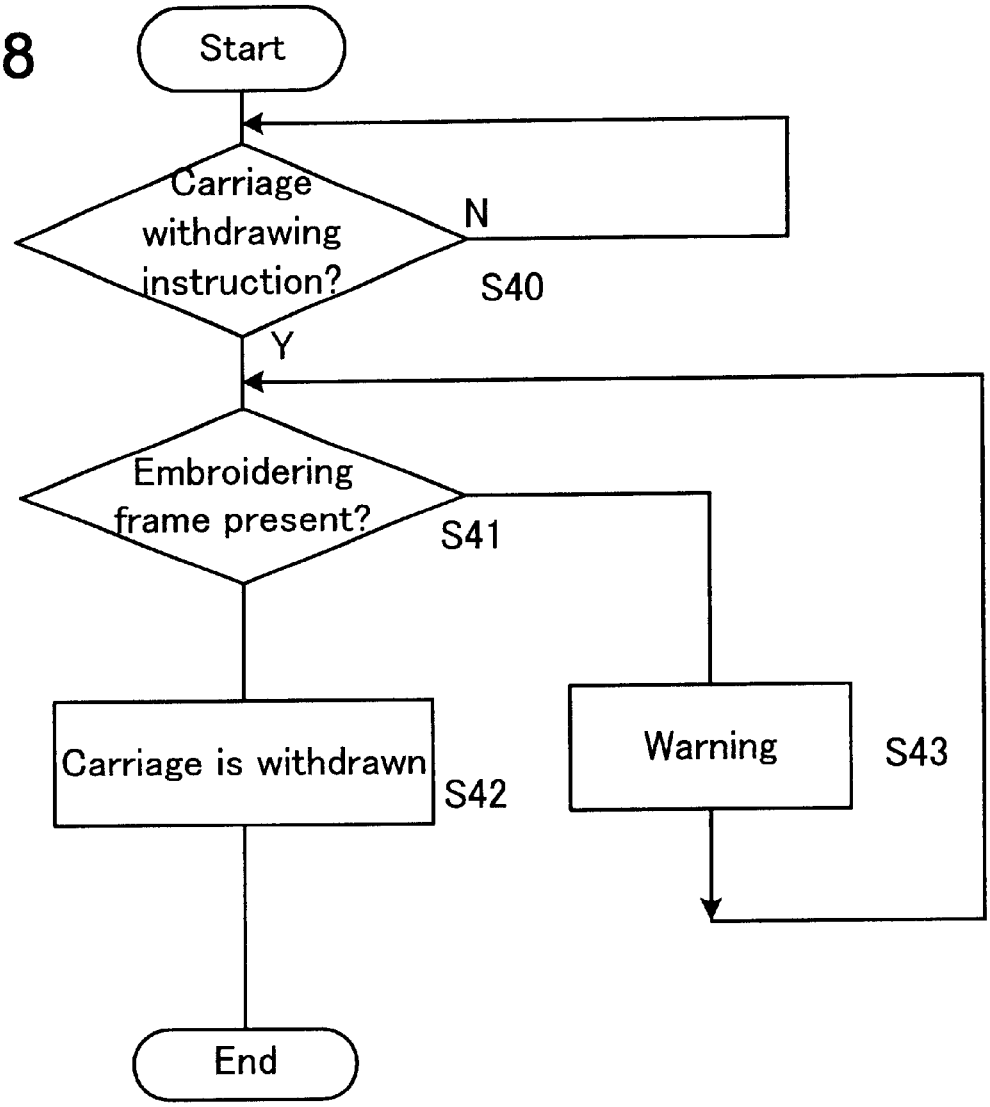
FIG. 8 is a flow chart showing the operations of another embodiment of the invention.

The operation will be described in reference to FIG. 8.

In case the distal end carriage 7 is ready to move (step S40), the CPU 50 discriminates on the basis of the information from the frame detector 41 if the embroidering frame 21 is present on the distal end carriage 7 (step S41). In case the embroidering frame is absent, the CPU 50 allows the carriage 7 to move (step 42). In case the embroidering frame is present, the CPU 50 gives a warning to this effect at the display 56 (step 43). In case the user removes the embroidering frame 21 from the carriage 7, the carriage 7 is allowed to move (step 42).

Figure 9:
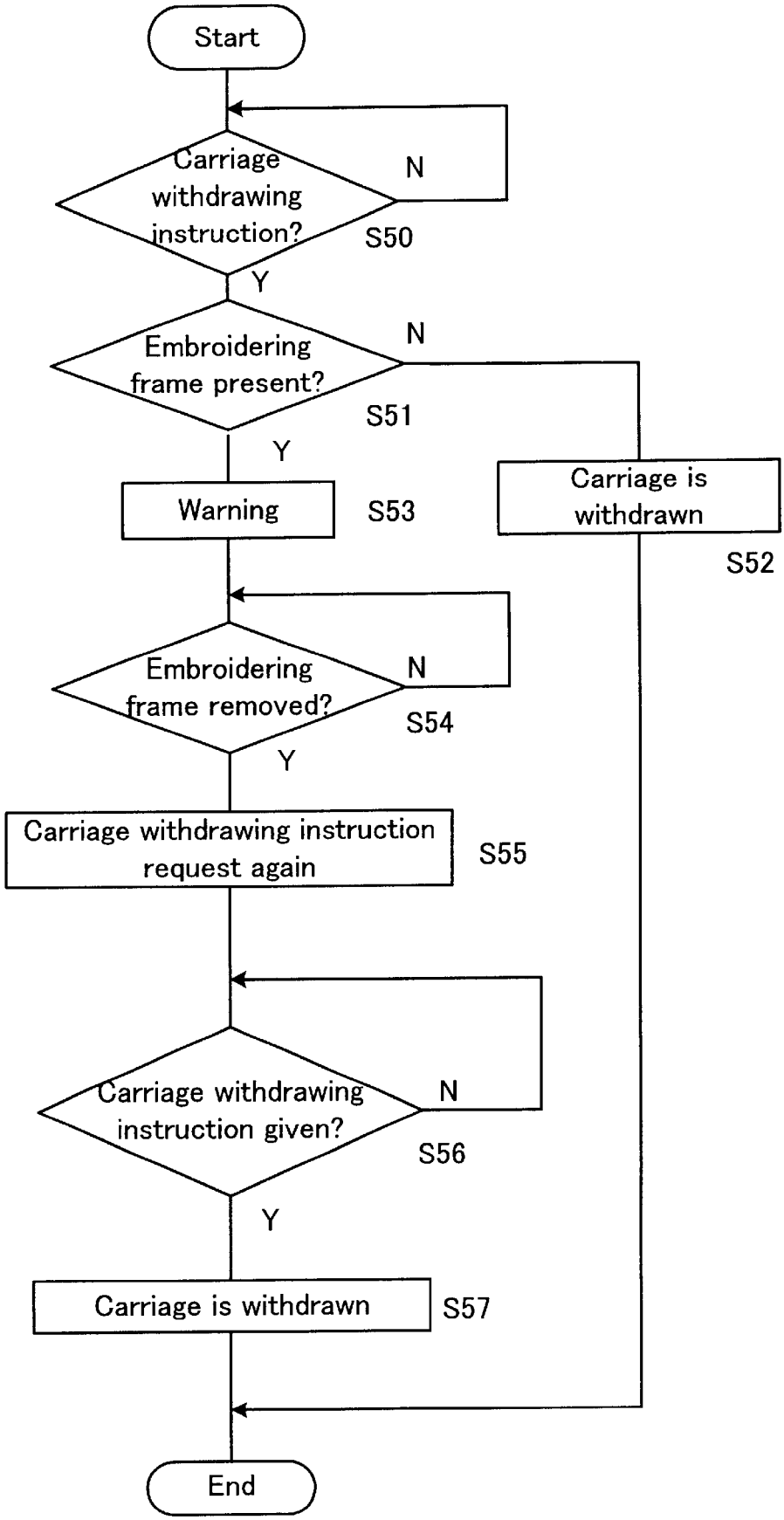
FIG. 9 is a flow chart showing the operations of still another embodiment of the invention.

Still another embodiment of the invention will be described in reference to FIG. 9.

The operation will be described in reference to FIG. 8.

In case the distal end carriage 7 is ready to move (step S50), the CPU 50 discriminates on the basis of the information from the frame detector 41 if the embroidering frame 21 is present on the distal end carriage 7 (step S51). In case the embroidering frame is absent, the CPU 50 allows the carriage 7 to move (step 52). In case the embroidering frame is present, the CPU 50 gives a warning to this effect at the display 56 (step 53). In case the user removes the embroidering frame 21 from the carriage 7 (step 54), the CPU 50 gives a notice at the display 56 requiring the user to take the initializing operation again (step S55). In case the user takes the initializing operation (step S56), the carriage 7 is allowed to move (step 57).

According to the second and third embodiments of the invention as described above, prior to starting the movement of distal end carriage 7, it is detected if the embroidering frame 21 is present or not on the carriage 7. In case the embroidering frame 7 is present, the carriage 7 is prevented from being moved until the embroidering frame 21 is removed. It is, therefore, possible to prevent the accident that the embroidering frame 21 will otherwise interfere with another member of sewing machine on the way withdrawing to the predetermined position. Further, since the notice is given to remove the embroidering frame 21, the user may instantly take the required action.

Further, in case of starting the distal end carriage 7 again, the instruction is represented so that the user may operate the sewing machine in accordance with the instruction.

Finally according to the invention, the embroidery sewing machine may be prevented from being left for a long time as the embroidering frame is extended out from the sewing machine, and further may be prevented from being damaged by interference of the embroidering frame with another member of the sewing machine.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An embroidery sewing machine having a stitch forming means including a vertically reciprocating needle and a means for holding a work to be stitched and being movable relative to the vertically reciprocating needle so that stitches may be formed on the work, said embroidery sewing machine comprising:

(a) a moving means for moving said work holding means relative to the vertically reciprocating needle;

(b) a means for detecting a power source of said sewing machine being off;

(c) a means for maintaining power supply in case the power source is detected to be off;

(d) a means operated by the maintained power supply to withdraw said moving means to a predetermined position.

2. The embroidery sewing machine as defined in claim 1, wherein said moving means includes a multi-stepped extendible mechanism composed of at least a first moving assembly and a second moving assembly which is movable on, relative to and in the same direction of said first moving assembly, and wherein said withdrawing means is operated to withdraw at least a half of a total length of said first and second moving assemblies.

3. The embroidery sewing machine as defined in claim 1, wherein said power supply maintaining means includes a means for postponing the time for interruption of power.

4. The embroidery sewing machine as defined in claim 1, wherein said power supply maintaining means includes a battery.

5. The embroidery sewing machine as defined in claim 1, further comprising a means for setting said predetermined position.

6. The embroidery sewing machine as defined in claim 1, further comprising a means for giving information regarding the weight of said work holding means and means for deciding said predetermined position on the basis of said information.

7. The embroidery sewing machine as defined in claim 1, further comprising a means for detecting a position of said work holding means and means for memorizing a position of said work holding means at which said work holding means is located before the same is withdrawn to said predetermined position.

8. The embroidery sewing machine as defined in claim 1, wherein said withdrawing means is designed to move said moving means only in the depth direction of said sewing machine.

9. The embroidery sewing machine as defined in claim 1, further comprising a means for operating said stitch forming means to form stitches for preventing loosening of the preceedingly formed stitches before said moving means is withdrawn to said predetermined position.

10. The embroidery sewing machine as defined in claim 1, further comprising a means for rendering said sewing machine into an economy mode for saving power in case said moving means has been withdrawn to said predetermined position.

11. An embroidery sewing machine having a stitch forming means including a vertically reciprocating needle and a means for holding a work to be stitched and being movable relative to the vertically reciprocating needle so that stitches may be formed on the work, said embroidery sewing machine comprising:

(a) a moving means for moving said work holding means relative to the vertically reciprocating needle;

(b) a first detecting means for detecting said stitch forming means and said work holding means being stopped;

(c) a second detecting means for detecting an elapse of time from the time said stitch forming means and said work holding means have been stopped;

(d) a means for discriminating if said elapse of time is more than a predetermined elapse of time, said discriminating means withdrawing said moving means to a predetermined position.

12. The embroidery sewing machine as defined in claim 11, wherein said moving means includes a multi-stepped extendible mechanism composed of at least a first moving assembly and a second moving assembly which is movable on and relative to said first moving assembly, and wherein said withdrawing means is operated to withdraw at least a half of a total length of said first and second moving assemblies.

13. The embroidery sewing machine as defined in claim 11, further comprising a means for setting said predetermined elapse of time.

14. The embroidery sewing machine as defined in claim 11, further comprising a means for setting said predetermined position.

15. The embroidery sewing machine as defined in claim 11, further comprising a means for giving information including at least a weight of said work holding means; and a means for deciding said predetermined position on the basis of said weight of said work holding means.

16. The embroidery sewing machine as defined in claim 11, further comprising a means for detecting a position of said work holding means; and a means for memorizing a position of said work holding means prior to withdrawal of said work holding means to said predetermined position.

17. The embroidery sewing machine as defined in claim 11, wherein said means for withdrawing said moving means is operated to move said moving means only in a depth direction of said sewing machine.

18. The embroidery sewing machine as defined in claim 11, further comprising a means for operating said stitch forming means prior to withdrawal of said moving means to form the stitches for preventing the preceding formed stitches from loosening.

19. The embroidery sewing machine as defined in claim 11, further comprising a means for rendering said sewing machine in an economy mode for saving power when said moving means has been withdrawn to said predetermined position.

20. An embroidery sewing machine having a stitch forming means including a vertically reciprocating needle and a means for holding a work to be stitched and being movable relative to the vertically reciprocating needle so that stitches may be formed on the work, said embroidery sewing machine comprising:

(a) a moving means for moving said work holding means relative to the vertically reciprocating needle;

(b) an operating means operated to withdraw said moving means to a predetermined position;

(c) a means responsive to operation of said operating means to control said moving means to move to said predetermined position; and (d) a means for rendering said sewing machine in an economy mode for saving power when said moving means has been withdrawn to said predetermined position.

21. An embroidery sewing machine having a stitch forming means including a vertically reciprocating needle and a means for holding a work to be stitched and being movable relative to the vertically reciprocating needle so that stitches may be formed on the work, said embroidery sewing machine comprising:

(a) a moving means for moving said work holding means relative to the vertically reciprocating needle;

(b) an operating means operated to withdraw said moving means to a predetermined position;

(c) a means responsive to operation of said operating means to control said moving means to move to said predetermined position; and (d) a means responsive to operation of said operating means to operate said stitch forming means prior to withdrawal of said moving means to form the stitches for preventing the preceding formed stitch from loosening.

22. An embroidery sewing machine having a stitch forming means including a vertically reciprocating needle and a means for holding a work to be stitched and being movable relative to the vertically reciprocating needle so that stitches may be formed on the work, said embroidery sewing machine comprising:

(a) a moving means for moving said work holding means relative to the vertically reciprocating needle;

(b) an operating means operated to withdraw said moving means to a predetermined position;

(c) a means responsive to operation of said operating means to control said moving means to move to said predetermined position;

wherein said withdrawing means is operated to withdraw said moving means only in a width direction of said sewing machine.

23. An embroidery sewing machine having a stitch forming means including a vertically reciprocating needle and a means for holding a work to be stitched and being movable relative to the vertically reciprocating needle so that stitches may be formed on the work, said embroidery sewing machine comprising:

(a) a moving means for moving said work holding means relative to the vertically reciprocating needle;

(b) an operating means operated to withdraw said moving means to a predetermined position;

(c) a means responsive to operation of said operating means to control said moving means to move to said predetermined position;

wherein said moving means includes a multi-stepped extendible mechanism composed of at least a first moving assembly and a second moving assembly which is movable on, relative to and in the same direction of said first moving assembly, and wherein said withdrawing means is operated to withdraw at least a half of a total length of said first and second moving assemblies.

24. The embroidery sewing machine as defined in claim 20, further comprising a means for setting said predetermined position.

25. An embroidery sewing machine having a stitch forming means including a vertically reciprocating needle and a means for holding a work to be stitched and being movable relative to the vertically reciprocating needle so that stitches may be formed on the work, said embroidery sewing machine comprising:

(a) a moving means for moving said work holding means relative to the vertically reciprocating needle;

(b) an operating means operated to withdraw said moving means to a predetermined position;

(c) a means responsive to operation of said operating means to control said moving means to move to said predetermined position;

(d) a means for giving information including a weight of said work holding means; and a means for deciding said predetermined position on the basis of said information.

26. The embroidery sewing machine as defined in claim 20, further comprising a means for detecting a position of said work holding means; and a means for memorizing a position of said work holding means prior to withdrawal of said work holding means to said predetermined position.

27. An embroidery sewing machine having a stitch forming means including a vertically reciprocating needle and a means for holding a work to be stitched and being movable relative to the vertically reciprocating needle so that stitches may be formed on the work, said embroidery sewing machine comprising:

(a) a moving means for moving said work holding means relative to the vertically reciprocating needle, said moving means having said work holding means removably mounted thereto and being movable to at least one predetermined position;

(b) a means for detecting presence of said work holding means on said moving means, said detecting means detecting absence of said work holding means on said moving means to move said moving means to said predetermined position.

28. The embroidery sewing machine as defined in claim 27, wherein said at least one predetermined position includes a first position where said moving means is located when the ordinary stitching operation is carried out and a second position where said moving means is located when the embroidery stitching operation is started.

29. The embroidery sewing machine as defined in claim 27, wherein said detecting means is responsive to turning on of a power source of said sewing machine to move said moving means to said first or second position.

30. The embroidery sewing machine as defined in claim 27, wherein said detecting means moves said moving means to said first or second position instantly upon detecting absence of said work holding means on said moving means.

31. The embroidery sewing machine as defined in claim 27, wherein said detecting means moves said moving means to said first or second position in response to an instruction which is given after said detecting means detects absence of said work holding means on said moving means.

32. The embroidery sewing machine as defined in claim 27, further comprising a means for giving a notice in response to detection by said detecting means of the presence of said work holding means on said moving means.

33. The embroidery sewing machine as defined in claim 31, further comprising a means for noticing a user to give said instruction.

* * * * *